United States Patent [19]

Navi

[11] 4,445,433

[45] May 1, 1984

[54] METHOD AND APPARATUS FOR VARIABLE DENSITY INKING

[76] Inventor: Menashe Navi, 12 E. 18th St., New York, N.Y. 10003

[21] Appl. No.: 365,013

[22] Filed: Apr. 2, 1982

[51] Int. Cl.[3] ..... B41F 31/06; B41L 27/08

[52] U.S. Cl. ..... 101/350

[58] Field of Search ..... 101/350, 351, 352, 349, 101/363, 364, 148, 206, 207, 208–210, 49, 51, 204, 315, 321, 326, 330, 331, 340, 341, 344, 345, 347, 355, 356, 357, 360, 361

[56] References Cited

U.S. PATENT DOCUMENTS

| | | | |
|---|---|---|---|
| 2,163,374 | 6/1939 | Crafts | 101/349 |
| 2,256,514 | 9/1941 | Brueshaber | 101/350 |
| 2,613,600 | 10/1952 | McWhorter | 101/350 |
| 2,915,009 | 12/1959 | Chase | 101/349 |
| 2,986,088 | 5/1961 | Chase et al. | 101/350 |
| 3,098,437 | 7/1963 | Tyma, Jr. et al. | 101/350 |
| 3,585,932 | 6/1971 | Granger | 101/350 |
| 3,587,463 | 6/1971 | Granger | 101/350 |
| 3,926,114 | 12/1975 | Matuschke | 101/350 |
| 4,244,292 | 1/1981 | Williams et al. | 101/350 |
| 4,263,848 | 4/1981 | Matalia et al. | 101/350 |
| 4,290,363 | 9/1981 | Köbler | 101/351 |
| 4,373,443 | 2/1983 | Matalia et al. | 101/350 |

*Primary Examiner*—J. Reed Fisher

[57] ABSTRACT

The present invention is directed to a variable density inking apparatus for use in a lithographic press, letter press, flexographic system or the like. The apparatus includes an anilox roll, means for feeding metered quantities of ink to the anilox roll surface, and a printing roll. A form roll is in peripheral engagement with the anilox roll and in ink delivering relation to the printing roll or to a further form roll. A characterizing feature of the invention lies in the provision of means for driving the form roll and anilox roll in the same direction while permitting relative speed variations in peripheral speed between the noted rolls in a ratio of from 1:1 to about 3:1 in either sense, thereby to enable an infinite variation in printing density.

8 Claims, 5 Drawing Figures

METHOD AND APPARATUS FOR VARIABLE DENSITY INKING

BACKGROUND OF THE INVENTION

1. Field of the Invention

This invention is in the field of printing and pertains more particularly to a method and apparatus for varying the density of a printed image.

1. The Prior Art

It is well known that the density of a printed image is dependent largely upon the quantum of ink delivered to the printing roll of a printing press.

In printing systems heretofore known substantial difficulties have been encountered in achieving a desired printing density. Density may vary across the printed image where certain elements of the image require higher concentrations of ink than others.

Desirably, the printing roll during each cycle of operation has deposited thereon a repeatable and precisely determined quantity of ink. Where, however, certain portions of the image, in the course of printing, result in large quantities of ink being removed from the roll supplying ink to the printing roll, a larger quantum of ink must be replaced on the supply roll to such areas than to other areas of the supply roll where little ink has been removed.

Numerous systems have been suggested for assuring the application of repeatable quantities of ink to the printing cylinder. Certain such systems employ a train of intermediate rolls between the ink supply and the printing cylinder together with a multiplicity of ink keys transversely located across the width of the roll train at various positions. By proper adjustment of the keys, there may ultimately be obtained a printed image having a desired density across the entire width. However, adjustment of each such key affects an interaction with the adjustment of the other keys, with the result that the services of a highly skilled operator are necessary for manipulation of the keys, and even such skilled operator will waste many hundreds of pages before a balancing is effected.

Where a desired balance is achieved, if the printing density is to be modified a still further series of manual adjustments must be effected. The criticality of such adjustments is most apparent in color printing operations where the tone or color of the ultimate printed image is dependent upon the density of each of the respective color layers which is over-printed.

In accordance with certain inking systems, known for instance as flexographic or flexo printing, uniform density across the width of the image may be easily achieved. Such systems employ a so-called anilox roll, i.e. a roll having a multiplicity of minute recessed cells in the surface which, by virtue of the geometry of the cells, draws a more or less precise amount of ink from the ink fountain or other supply during each revolution.

The anilox roll will deliver a precisely equal quantum of ink to the printing cylinder. This is so because, if larger quantities of ink are removed from the anilox roll, the depleted cells will be free to receive greater amounts of ink from the source than will those cells from which only small quantities of ink have been removed.

A disadvantage of the flexo system resides in the fact that it is difficult to vary within small gradations the over-all density of the image, a procedure which is particularly desirable in color printing. This is so because the long train of rolls which permit density adjustment in conventional printing procedures is eliminated in the interests of obtaining uniform side-to-side density in the manner noted above.

In a flexo printing system, density variations are effected by removing a given anilox roll and substituting a different roll having different cell capacities. Such method of controlling density provides only limited shades or nuances, i.e. one for each roll. In addition, anilox rolls are expensive.

An alternate proposed method for providing variable density and across-the-page density consistency is suggested in U.S. Pat. No. 4127,067.

In accordance with the method of such patent, a uniform ink film is obtained by indenting a first roll into the surface of a second roll to deform said surface while rotating the indenting roll at very high speeds in the order of thousands of rpm in counter-direction to the indented roll, utilizing the ink film as a lubricant.

The device of this patent has proven commercially unsuccessful and impracticable due to its complexity and to the rapid wearing away of the indented roll. Moreover, if the ink film should be removed even for an instant, the surface of the indented roll is destroyed, necessitating replacement.

SUMMARY OF THE INVENTION

The invention may be summarized as directed to an apparatus and method of enabling the production of an image of infinitely variable density by a simple means which, at the same time, assures a coherent across-the-width density characteristic.

In accordance with the invention, an anilox roll is caused to receive a precisely metered amount of ink from an ink fountain. Preferably a negative angle doctor blade is employed to assure a consistent ink application.

The periphery of the inked anilox roll is engaged by one or more forming rolls which function to remove ink from the anilox roll and apply the same to a printing roll in the conventional manner.

A characterizing feature of the invention is the provision of means for varying the peripheral speed of the anilox in relation to the form rolls which are turning in the same direction in a ratio range preferably of from 1:1 to about 3:1, and normally in the range of from 1:1 to 2:1 in either sense.

I have discovered that a maximum density is achieved when the peripheral speeds of the anilox and form rolls are identical, and the density is progressively reduced with an increase in relative speed between the anilox and form rolls.

While it is preferred that image density be reduced by increasing the peripheral speed of the anilox roll relative to the form roll, density variation may be obtained and accurately controlled where the peripheral speed of the anilox roll is slower than that of the form roll.

It is accordingly an object of the invention to provide a variable density inking apparatus as well as a printing press embodying such apparatus.

A further object of the invention is the provision of a method of varying the density of a printed image.

Still a further object of the invention is the provision of an apparatus and method susceptible of providing an infinite variety of printed image densities characterized in that an anilox roll and at least one form roll in peripheral contact with the anilox roll are caused to rotate in the same direction but at a speed which varies or may be varied within a range of from 1:1 for maximum image density to about 1:3 in either sense, and preferably in the range of from 1:2.

To obtain these objects and such further objects as may appear herein or be hereinafter pointed out, reference is made to the accompanying drawings, forming a part hereof, in which.

Figure 1:
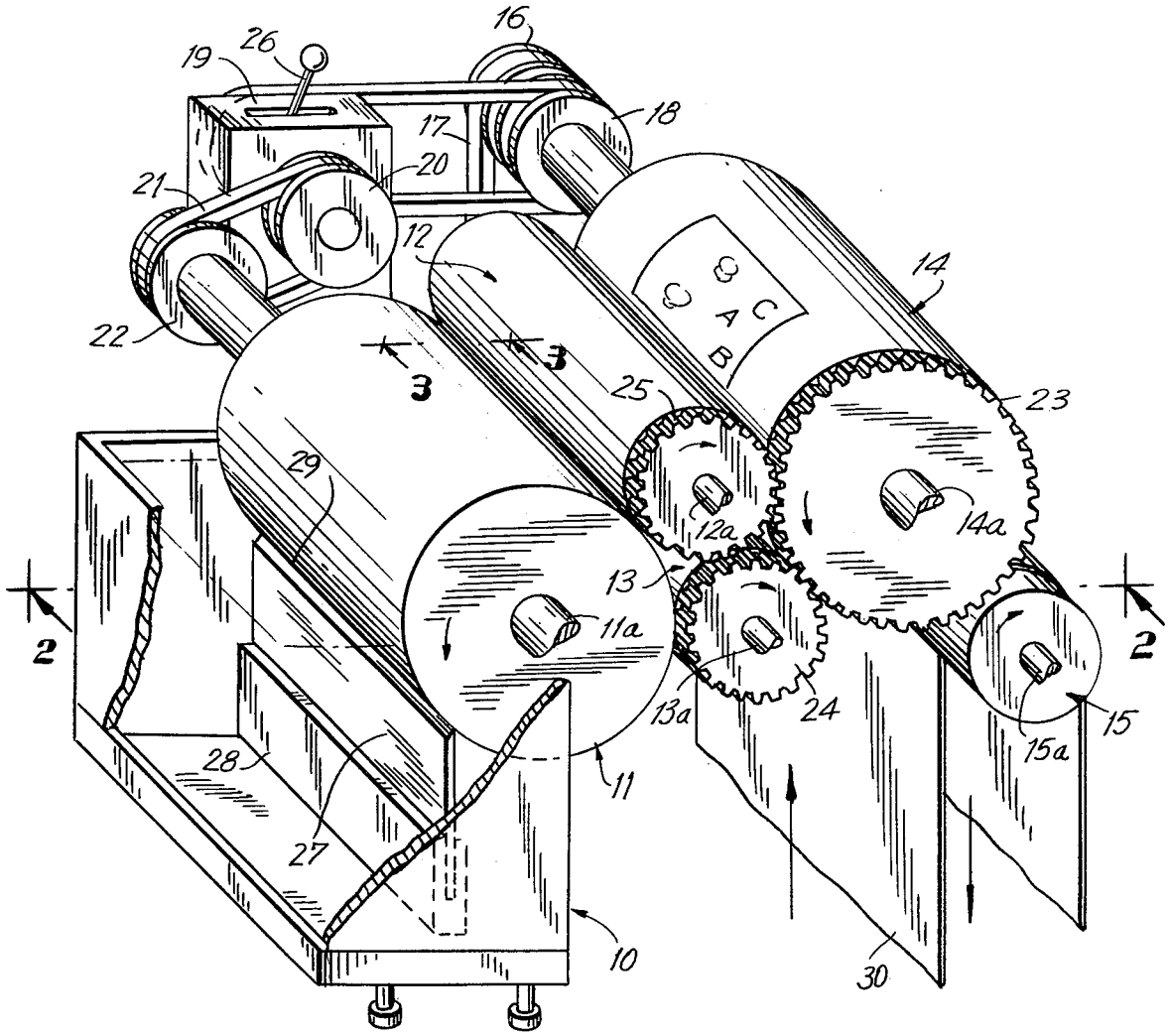
FIG. 1 is a schematic perspective view of a printing apparatus in accordance with the invention.

Referring now to the drawings, there is shown in FIG. 1 in schematic or diagrammatic fashion a printing apparatus including generally an ink fountain assembly 10, an anilox roll 11, upper and lower form rolls 12, 13, respectively, a plate cylinder 14 and an impression cylinder 15. It will be understood that each of the cylinders 11 through 15 is mounted for rotation about parallel axes on shafts 11*a* through 15*a*, respectively, the shafts being journalled in a frame assembly (not shown).

The shaft 14*a* of the plate cylinder 14 is driven via a power source (not shown) connected to drive pulley 16 linked to the power source by belt 17. Pulley 18, likewise mounted on shaft 14*a* of the plate cylinder, is connected to an input pulley (not shown) of variable speed drive mechanism 19, the output pulley 20 of which is linked by belt 21 to drive pulley 22 fixed to shaft 11*a* of the anilox of metering roll member.

Shaft 14*a*, at the end remote from the driven end, is provided with a drive gear 23 meshing with the teeth of drive gears 24, 25 mounted on shafts 13*a* and 12*a* respectively, of the form rolls 13 and 12.

It will thus be seen that in the illustrated embodiment the rolls 12 and 13 will be driven at a peripheral speed which is fixed relative to the peripheral speed of the plate cylinder, the ratios of the gears 24 and 25 being coordinated with gear 23 in such manner as to have the peripheral speeds of the form rolls identical with the peripheral speed of the plate cylinder.

The impression cylinder 15 may be driven by means (not shown) at the same peripheral speed as the plate cylinder or may function, in some circumstances, in the manner of an idler roll.

The peripheral speed of the anilox roll 11 may be varied relative to the peripheral speeds of the form rolls 12 and 13 by adjustment of the control lever 26 of the variable speed drive 19 in such manner as to permit the production of at least about a 2:1 peripheral speed ratio with the form rolls.

Normally it is preferred that the variable speed apparatus be capable of driving the anilox roll 11 at a more rapid peripheral speed than the form rolls, a ratio of 1:3 and normally up to 1:2 providing sufficient speed variations as to enable a full gamut of density adjustment.

As will be more fully set forth hereinafter, a reverse ratio or ratio in an opposite sense between the anilox roll and the form rolls, i.e, a situation where the form rolls operate at a greater peripheral speed than the anilox roll in the same proportional range noted above also provides a functional arrangement.

It is to be noted that while the ratios noted are considered to provide the most practical and accurate printing procedure the ratio may be extended somewhat in noncritical printing applications. For example, if a coarse anilox roll is employed, with consequent high ink carrying capacity, it may be possible to utilize ratios of 10:1 and achieve satisfactory results.

The periphery of anilox roll 11 is disposed in ink receiving position within the ink fountain 10. Uniform filling of the cells of the anilox roll is assured by the provision of a reverse angle doctor blade 27 supported in blade holder 28, the edge 29 of the blade being in wiping engagement with the periphery of the anilox roll 11 in a manner known per se.

In advance of a description of the operation of the device and in compliance with the requirements of the patent laws, there is set forth hereinafter a series of specific operating characteristics of the components of a representative inking system, it being understood that such characteristics should not be taken in a limitative sense but, rather, are for purposes of illustration only.

The method and apparatus of the invention have been successfully practiced utilizing anilox rolls having metal or ceramic coatings, the rolls being preferably preloaded in fixed position bearings. Anilox rolls have been successfully employed having cell concentrations in the range of 200 to 800 cells per lineal inch and having cell carrying capacities of from 0.2 cubic billion microns to 30 cubic billion microns per square inch.

Anilox rolls of a variety of cell configurations have been successfully tested, a preferred configuration employing cells with a semi-spherical base wherein the diameter of each cell is in the range of from about 5 to 40 microns and the land area between cells from about 5 to 10 microns.

A suitable range of anilox rolls is manufactured by the C.S.I. Corporation of Butler, Wis. and/or Pamarco Incorporated of Roselle, N.J.

In an illustrative installation there have been employed as form rolls metal core, rubber covered rolls having a durometer of 45 to 50 (Shore A). The form rolls are preferably mounted on bearings having eccentric capability to the anilox roll and to the plate cylinder. Preferably the form rolls differ in diameter. By way of example, roll 12 may be of a 3" diameter and roll 13 of 3½" diameter and may be driven at speeds of up to 1500' per minute.

The plate cylinder 14 is preferably mounted on bearings having eccentric capabilities so as to permit an adjustment of the pressures with which the same bear against the sheet 30 which is disposed between the plate cylinder 14 and the impression cylinder 15. The diameter of the plate cylinder will, of course, be dependent upon the size of the image.

As an impression cylinder in an illustrative embodiment there has satisfactorily been employed a metal core roll having a rubber covering of 90 durometer (Shore A).

A doctor blade employed in the subject installation is a metal member 0.008" in thickness by 1½" in depth. The sharpened edge of the blade is engaged against the surface of the anilox roll at an included angle of from about 30° to 35° between the edge of the doctor blade and a vertical plane through the point of tangency of the blade against the surface of the anilox roll. A suitable blade is available from Allison Systems, Inc. or Moorstown, N.J.

Suitable leveling means are provided for the ink fountain, and wiper adjustment means are supplied, as is conventional, to prevent the escape of ink from around the sides of the anilox roll.

While the device may be used with a variety of different printing inks, it is preferred to use a relatively high viscosity ink, such as letter press, offset, or ultra violet drying ink of 100 or more cps.

Figure 2:
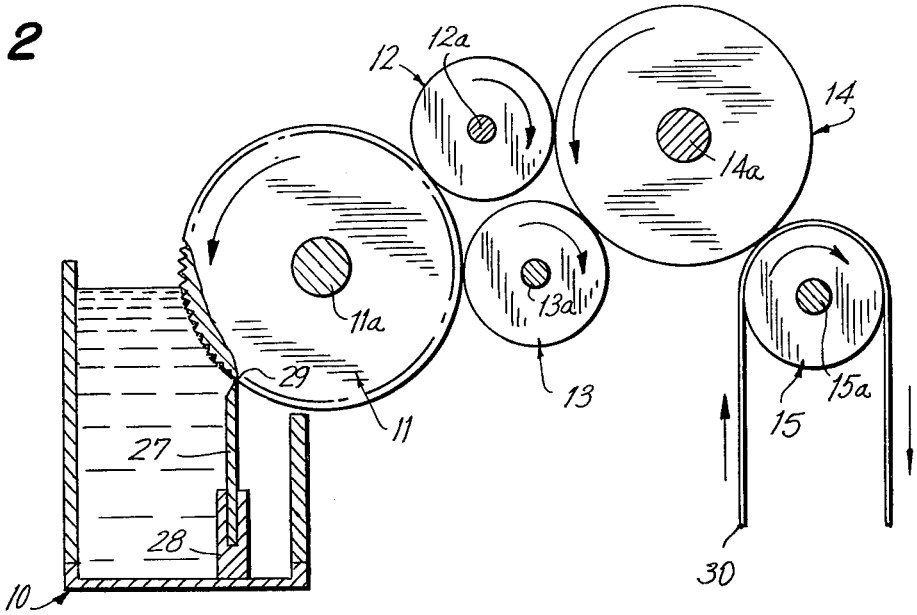
FIG. 2 is a sectional view taken on the line 2—2 of FIG. 1.
Figure 3:
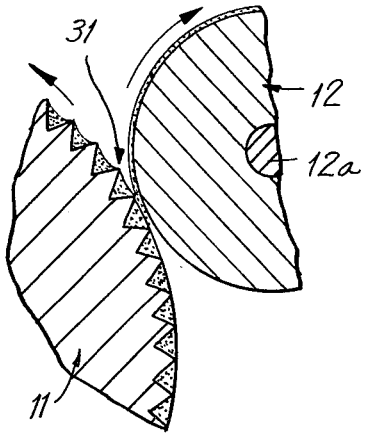
FIG. 3 is a magnified fragmentary sectional view taken on the line 3—3 of FIG. 2.

The operation of the device, which will be apparent from the preceding discussion, is described in somewhat greater detail in connection with FIGS. 2 and 3.

As disclosed in such figures, the anilox roll passes through the ink in the fountain 10, partially filling the cells 31 to a precisely determinable and repeatable degree which is a function of cell configuration, ink viscosity and surface tension, etc. The anilox roll 11, which is rotating in the direction of the arrows shown in FIGS. 1 and 2 is brought into contact with the form rolls 13 and 12, which indent slightly into the cells, removing increments of ink from the cells and depositing the same on the rubber surface of the form rolls.

While the use of two form rolls 12 and 13 is not necessary it is preferred, and it will be readily recognized that a single form roll contacting the anilox roll and the surface of the plate cylinder 14 provides a satisfactory arrangement.

The ink is transferred from form rolls 12 and 13 to the surface of the plate cylinder 14. The sheet 30 to be imprinted passes in the nip between the plate cylinder and impression cylinder 15, whereupon the desired image is imprinted on the paper 30.

Figure 4:
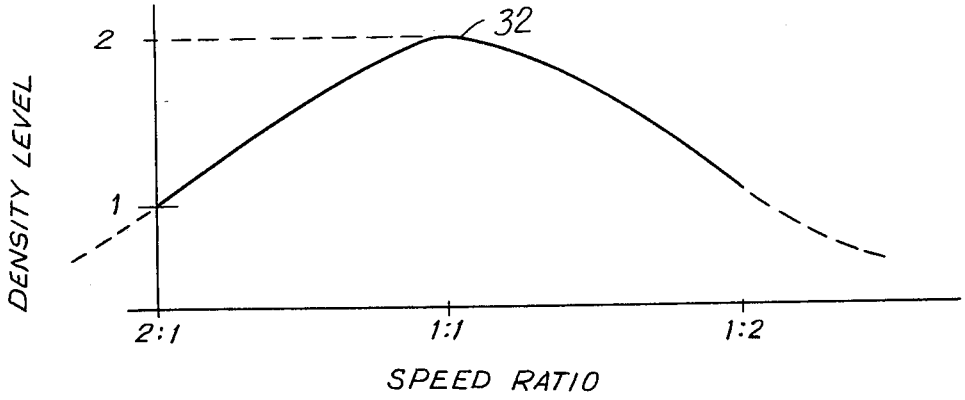
FIG. 4 is a graphic illustration of printing density as a function of speed ratio between anilox and form rolls.

FIG. 4 is a graph illustrating the variations in print density achieved by varying the relative speeds of the form rolls and the anilox roll.

As hereinbefore noted, while it is preferred, should a density reduction be desired, to increase the speed of the anilox roll relative to the peripheral speed of the form rolls, less satisfactory but acceptable results can be obtained if the form rolls travel at a greater speed than the anilox roll.

As is seen from the graph, the greatest density of image occurs at a position 32 wherein the speed ratio of anilox roll periphery to form roll periphery is 1:1. It is thus desirable to select as the anilox roll for a particular operation a roll having a cell configuration which, at maximum deposit application, will provide an image denser than that which is ultimately desired.

The operator, after running a few sample prints, will adjust the variable speed drive 19 in such manner as to reduce the density of the image until the desired lower density image is achieved.

The precise mechanics by which density reduction is achieved are not known. It is theorized, however, as represented by FIG. 3 of the drawing, that when a 1:1 ratio between form roll and anilox roll is present, the increments of form roll which enter into the cells under the comprehensive forces employed are able to remove a maximum of ink under the influences of surface tension, tack and the like. However, when a speed variation is introduced, a wiping action occurs, which wiping action reduces the effect of those factors which transfer ink from the anilox to the form rolls. The effectiveness of the wiping action increases with the relative speed differential.

Experiments have demonstrated that there is an almost directly proportionate reduction in image density with relative speed increase within the parameters of a 1:1 to 2:1 ratio of linearity, decreasing as the ratio proceeds beyond 2:1 to about 3:1 and beyond.

As will be apparent from the preceding description, there is provided in accordance with the invention a simple and yet highly effective means for infinitely varying the image density in a letter press or flexo printing system.

The use of form rolls of somewhat different diameters is preferred to reduce "ghosting" but, as hereinabove noted, form rolls of the same diameter, or a single form roll may be satisfactorily employed in accordance with the method and apparatus.

Figure 5:
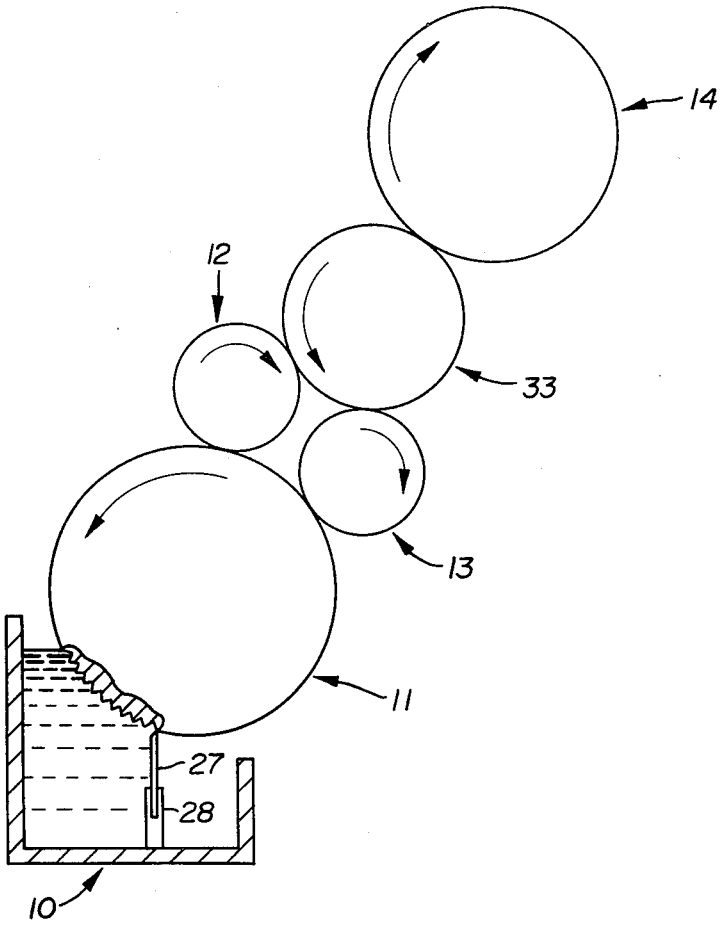
FIG. 5 is a schematic view similar to FIG. 3 showing an embodiment of the invention.

As will be apparent to those skilled in the art and familiarized with the instant disclosure, numerous variations in details of construction may be made without departing from the spirit of the present invention. For example, it is feasible to introduce a still further form roll or rolls in ink transferring relation between the anilox contacting form rolls and the plate cylinder i.e. roll 33 of the embodiment of FIG. 5 wherein like parts have been given like reference numerals. Also the preferred speed ratio of from 1:1 to 3:1 in either sense should not be considered limitative except as claimed since, as noted above, higher ratios may be employed for non-critical printing operations where a metering roll of sufficiently high capacity is used.

Accordingly, the invention is to be broadly construed within the scope of the appended claims.

Having thus described the invention and illustrated its use, what is claimed as new and is desired to be secured by Letters Patent is:

1. A variable density inking apparatus for a printing apparatus employing a celled ink metering roll such as a letter press or lithographic press comprising ink fountain means, an anilox roll mounted in ink receiving position relative to said fountain means, said anilox roll including a multiplicity of outwardly open cells on the periphery thereof, metering means wipingly engaging the surface of said anilox roll for removing therefrom ink film externally of said cells, a printing roll rotatable relative to said anilox roll, at least one resilient form roll interposed between said printing roll and said anilox roll, said form roll being in peripheral contact with said printing roll and being pressed against said anilox roll to indent into said cells of said anilox roll, said anilox, form, and printing rolls being rotatable about parallel axes, the contacting portions of said rolls rotating in the same direction, the combination including means for varying the relative peripheral speed of said form and anilox rolls in the range of from about 1:3 to 3:1.

2. Apparatus in accordance with claim 1 wherein said ink metering means comprises a doctor blade engaging the surface of said anilox roll at a negative rake angle.

3. Apparatus in accordance with claim 1 and including a second forming roll engaging said anilox roll at a position spaced from the position of engagement between said anilox roll and said at least one form roll, the contacting portions of said second form roll and anilox roll moving in the same direction, the relative peripheral speeds of said second roll and anilox roll being the same as the relative speeds of said anilox and at least one roll.

4. Apparatus in accordance with claim 3 and including an ink transfer roll interposed in ink transferring relation between said printing roll and said at least one form roll.

5. Apparatus in accordance with claim 3 wherein the diameters of said at least one and said second form rolls are different.

6. Apparatus in accordance with claim 1 wherein said means for varying the relative peripheral speed results in said form roll moving at a lower peripheral speed than said anilox roll.

7. The method of varying the ink deposit density of a printing apparatus of the type which includes an ink fountain, an anilox roll having outwardly open cells in the periphery thereof, said anilox roll being disposed in ink receiving relation to said fountain, a doctor blade in wiping engagement to the surface of said anilox roll, thereby to remove ink from said anilox roll in areas external of said cells, at least one resilient form roll coaxially aligned with said anilox roll and in engagement therewith, and a printing roll in ink receiving relation to said form roll, comprising the steps of urging said form roll against said anilox roll, thus to indent the resilient material of said form roll into said cells while simultaneously causing the peripheral portions of said form and anilox rolls to move in the same direction and including a variation in peripheral speeds of said form and anilox rolls from a 1:1 ratio corresponding to a maximum printing density to a ratio of from about 1:3 to 3:1, thereby to reduce the printing density from said maximum.

8. The method in accordance with the claim 7 and including the step of causing the surface of said anilox roll emerging from said fountain to be engaged by a doctor blade inclined at a negative angle relative to said anilox roll, thereby to strip from the surface of said anilox roll ink externally of said cells.

* * * * *